US006498314B2

(12) United States Patent
Miyo et al.

(10) Patent No.: US 6,498,314 B2
(45) Date of Patent: Dec. 24, 2002

(54) VACUUM SWITCH AND VACUUM SWITCHGEAR USING THE SAME

(75) Inventors: Takuya Miyo, Hitachi (JP); Toru Tanimizu, Hitachi (JP); Syuuichi Kikukawa, Hitachi (JP); Katunori Kojima, Hitachi (JP); Ayumu Morita, Hitachi (JP); Hiroshi Yokoyama, Kumagaya (JP); Koichi Murata, Kashiwa (JP); Ryotaro Hanabuchi, Chiba (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/836,466

(22) Filed: Apr. 18, 2001

(65) Prior Publication Data

US 2001/0040146 A1 Nov. 15, 2001

(30) Foreign Application Priority Data

Apr. 19, 2000 (JP) ..... 2000-123675

(51) Int. Cl.[7] ..... H01H 33/66
(52) U.S. Cl. ..... 218/118; 218/134; 218/155
(58) Field of Search ..... 218/118, 119, 218/120, 139, 140, 155, 134

(56) References Cited

U.S. PATENT DOCUMENTS 4,087,644 A * 5/1978 Weston ..... 218/139
6,335,502 B1 * 1/2002 Kikukawa et al. ..... 218/118

FOREIGN PATENT DOCUMENTS

| | | |
|---|---|---|
| JP | 55-143727 | 11/1980 |
| JP | 3-225718 | 10/1991 |
| JP | 3-273804 | 12/1991 |
| JP | 5-166440 | 7/1993 |
| JP | 9-153320 | 6/1997 |

* cited by examiner

*Primary Examiner*—Lincoln Donovan
(74) *Attorney, Agent, or Firm*—Mattingly, Stanger & Malur, P.C.

(57) ABSTRACT

A vacuum switch comprises a first vacuum container containing therein a circuit breaker, a second vacuum container containing therein the first vacuum container and grounded, and a third vacuum container connected to the second vacuum container, containing therein a disconnecting switch and an earth device and grounded. The second and third vacuum containers are isolated in vacuum from the first vacuum container, and the second vacuum container is electrically insulated from the first vacuum container. The second vacuum container contains an insulator fixed to a conductor connected to the circuit breaker and a movable rod partially disposed out of the vacuum containers and operating the circuit breaker to open and close. The disconnecting switch, circuit breaker and the insulator are arranged in a line. A vacuum switchgear comprises the above-mentioned vacuum switches of the number corresponding to three phases and necessary components, each being contained in a metal box.

20 Claims, 5 Drawing Sheets

VACUUM SWITCH AND VACUUM SWITCHGEAR USING THE SAME

BACKGROUND OF THE INVENTION

The present invention relates to a vacuum switch and a vacuum switchgear using the vacuum switch and, more particularly to a vacuum switch most suitable to be made small in size and a vacuum switchgear using the same.

As incoming transformer apparatuses to be made compact, a $SF_6$ gas-insulated switchgear is disclosed in JP A 3-273804, for example. In the switchgear, a circuit breaker, two disconnecting switches, and an earth device are individually manufactured and contained in a unit chamber filled with an insulating gas and a bus chamber arranged in a switch box. In the case where a vacuum circuit breaker is used as this circuit breaker, a movable electrode is moved up and down to a fixed electrode to close and open by an operation device of the circuit breaker. There is also a vacuum circuit breaker, as disclosed in JP A 55-143727. In the vacuum circuit breaker a movable electrode is rotated left and right about a main axis as a supporting point to contact with or separate from a fixed electrode, that is, to close or open. Further, there is a switchgear as disclosed in JP A 9-153320, which is constructed so that while a movable conductor arranged in one vacuum container is roundly moving between a fixed conductor and an earth conductor, the movable conductor moves to a close position, an open position, a disconnecting position and an earth position.

Further, JP A 5-166440 and JP A 3-225718 each disclose a vacuum switch constructed so that a vacuum bulb, an operation mechanism for operating the vacuum bulb and a disconnecting device are contained in a hermetically closed metal box or a switch case.

The $SF_6$ gas insulated-switchgear disclosed in JP A 3-273804 uses a $SF_6$ gas, so that it is required to reduce the $SF_6$ gas in view of a greenhouse effect. Therefore, a switchgear in which the $SF_6$ gas is not used is desired. In the vacuum circuit breaker disclosed in JP A 55-143727, since the container is not grounded, in order to perform maintenance inspection of the incoming transformer apparatuses, it is necessary to take sufficient safety measures such as prevention of re-application of current or voltage from a power source by causing remaining electric charges and induction current to flow into an earth by opening the disconnecting switch provided other than the circuit breaker and grounding the earth switch after opening the circuit breaker. In the circuit breaker, the apparatuses are individually provided, so that it is difficult to make the size of the circuit breaker small. Further, the switchgear disclosed in JP A 9-153320 is excellent in making the size small, however, since the close position, open position, disconnecting position and grounding position are provided in one vacuum container, it has such a disadvantage that all the functions are lost when an accident occurred by any chance. JP A 5-166440 and JP A3-225718 each disclose that the vacuum bulb is contained in the hermetically closed metal box or switch case, however, they do not disclose that the hermetically closed metal box or switch case is made vacuum, and that the hermetically closed metal box or switch case is grounded.

SUMMARY OF THE INVENTION

A first object of the present invention is to provide a vacuum switch which is made small in size and a switchgear using the vacuum switch.

Another object of the present invention is to provide a vacuum switch which can be suited for diversification of apparatuses and a switchgear using the vacuum switch.

Still another object of the present invention is to provide a vacuum switch which is improved in assemblage and a switchgear using the vacuum switch.

Further still another object of the present invention is to provide a vacuum switch which is improved in insulation and a switchgear using the vacuum switch.

In order to attain the above objects, a vacuum switch of the present invention comprises a first vacuum container containing therein a fixed electrode and a movable electrode of a circuit breaker, and a second vacuum container which is electrically insulated from the first vacuum container and grounded and contains therein the first vacuum container. The first vacuum container is communicable in vacuum with the second vacuum container, for example, through a small gap between an insulator forming a part of the first vacuum container and a conductor connected to a fixed or movable conductor and passing through the insulator. Thereby, the vacuum of the two vacuum containers reaches an equilibrium state under normal condition and is stable.

A wall of the first vacuum container containing therein the fixed electrode and the movable electrode of the circuit breaker and a wall of the second vacuum container are arranged at such a distance that the both walls are lower in potential than the potential of a bus, or at a relatively small distance. Particularly, they are arranged to keep such a distance that the potential of the wall of the first vacuum container becomes intermediate potential between the potential of the bus and the earth potential.

The second vacuum container also contains therein an insulator fixed both to the conductor electrically connected to the circuit breaker and to a movable rod for operating the circuit breaker to open and close.

A vacuum switch of the present invention comprises a first vacuum container containing therein a circuit breaker, a second vacuum container containing therein the first vacuum container and grounded, and a third vacuum container connected to the second vacuum container, containing therein a disconnecting switch and grounded. The first vacuum container is communicable in vacuum with the second vacuum container through a gap, however, the vacuum of the third vacuum container is isolated from the vacuum of the first and second vacuum containers.

The second vacuum container also contains therein an insulator fixed both to the conductor electrically connected to the circuit breaker and to a movable rod for operating the circuit breaker to open and close. Further, the disconnecting switch and the circuit breaker, preferably, the insulator fixed to the conductor and the movable rod also are arranged in a substantially straight line.

The vacuum switch is constructed so that a disconnecting switch and an earth device are contained in the third vacuum container. Further, at least one vacuum container containing the first vacuum container is provided between the first and second vacuum containers.

Further, a vacuum switchgear according to the present invention has switches as mentioned above of the number corresponding to three phases or more, and necessary elements such as a protective relay device and an operation box arranged in a metal box.

DESCRIPTION OF EMBODIMENTS OF THE INVENTION

Figure 1:
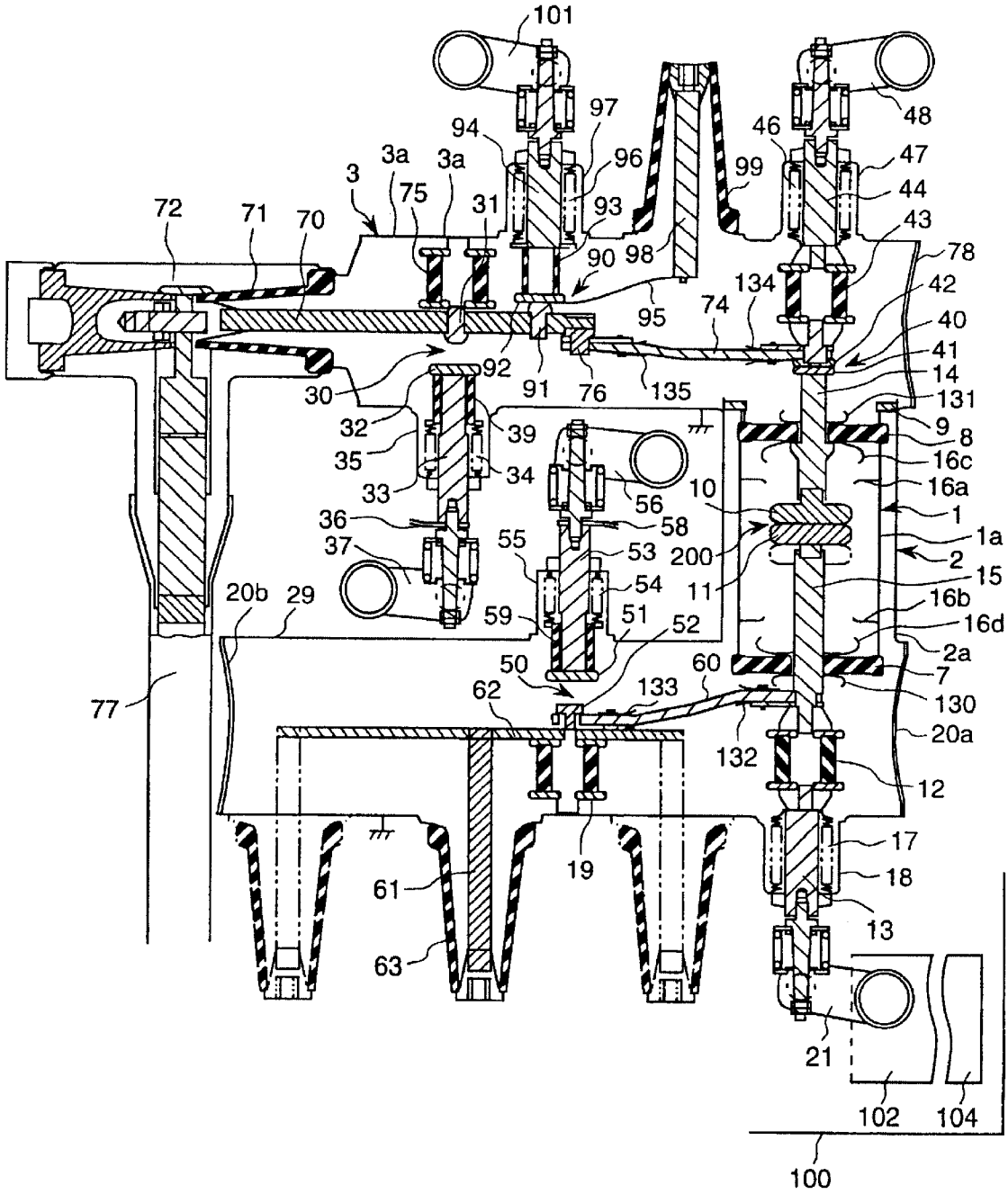
FIG. 1 is a sectional side view of a vacuum switchgear of a first embodiment of the present invention.
Figure 2:
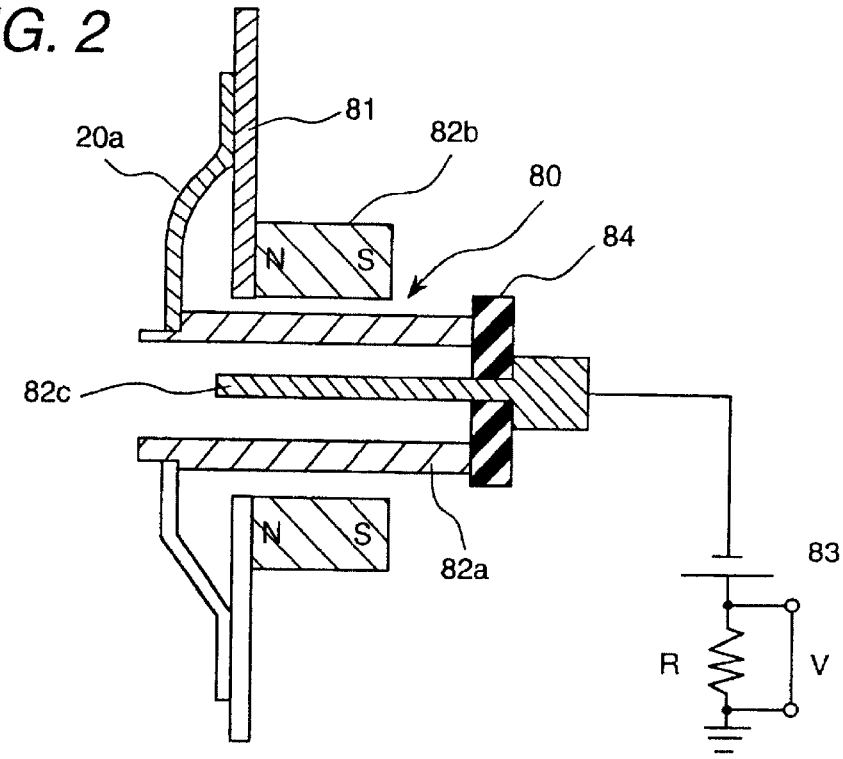
FIG. 2 is a sectional side view of a mounting construction of a vacuum measurement apparatus used in the vacuum switchgear of the first embodiment of the present invention.
Figure 3:
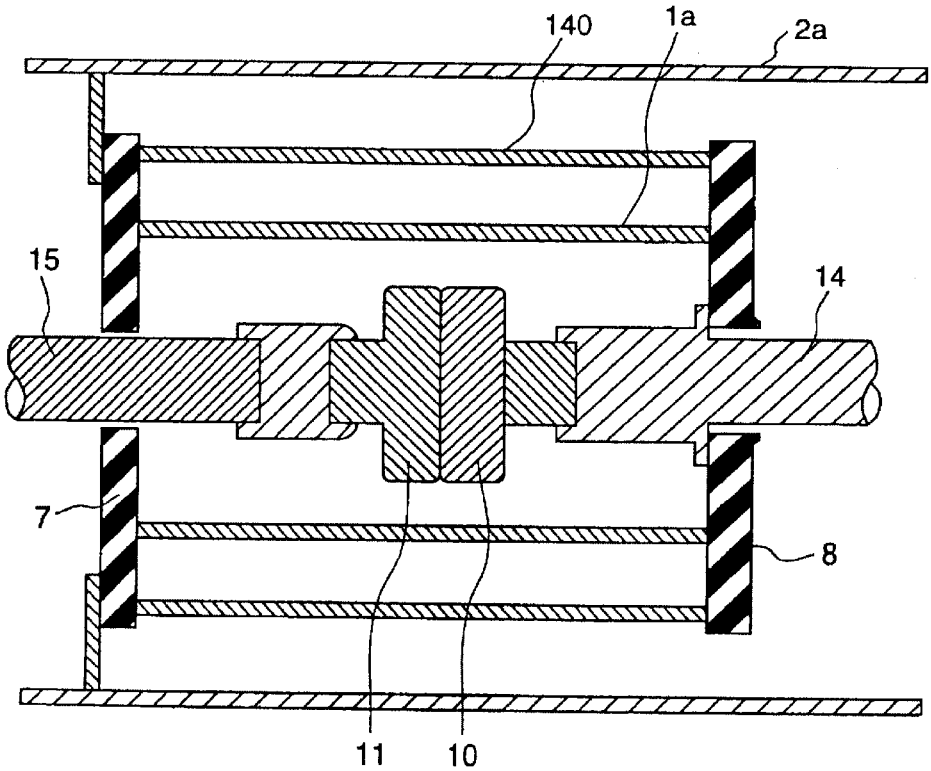
FIG. 3 is a vertical sectional view of a construction of modified vacuum containers used for the vacuum switchgear of FIG. 1.

An embodiment of the present invention will be described hereunder, referring to FIGS. 1 to 3. FIG. 1 is a sectional side view of a vacuum switchgear of the present embodiment, FIG. 2 is a sectional side view of a vacuum measurement apparatus used in the present embodiment, and FIG. 3 is an enlarged view of a modification of a part of a vacuum switch shown in FIG. 1.

As shown in FIG. 1, a switchgear of the present embodiment has a first vacuum container 1 containing therein a circuit breaker 200, a second vacuum container 2 containing therein the first vacuum container 1, and a third vacuum container 3 connected to the second vacuum container 2 through an insulator 8 and a conductive member or ring 9 (which may be made of insulating material) and containing therein an earth device 30 and a disconnecting switch 40, and each vacuum container is contained in a metal outer casing or box 100 partially shown. The second vacuum container is arranged so as to cover the outer peripheral side of the first vacuum container 1, keeping a distance which is from the outer peripheral side and set so that a side wall 1*a* of the first vacuum container 1 is intermediate potential lower than the potential of a bus which will be described later. The first vacuum container 1 also can be constructed so as to have a role as an arc shield which will be described later. A conductor 60 inside the second vacuum container 2 is made of a flexible conductor. The flexible conductor 60 is connected to a bushing 63 through a connecting conductor 62 and a fixed conductor 61, and the fixed conductor is connected to a bus not shown, using a connection portion not shown. The second and third vacuum containers of the number corresponding to three phases are arranged in the metal box 100. The buses of the number corresponding to three phases are taken out of the vacuum containers. A conductor 70 inside the third vacuum container 3 is connected to a cable 77 through a bushing 71 and a connection portion 72.

The second and third vacuum containers 2 and 3 each are grounded as mentioned later and the side walls 2*a* 3*a* of them are earth potential, so that it is possible to arrange the vacuum containers of three phases in contact with or in an adjacent relation to each other. A box 104 containing therein a protective relay is contained in the metal box 100 partially shown. When the protective relay detects occurrence of an accident or the like, an operation mechanism in an operation box 102 is controlled to control opening and closing of the circuit breaker 200, earth devices 30, 50 and disconnecting switch 40. An operation compartment is constructed by a box accommodating the operation box 102 and the box 104 containing therein the protective relay. Each apparatus of the operation compartment can be arranged adjacent to the vacuum containers because the second vacuum container 2 and the third vacuum container 3 each are earth potential, so that the whole switchgear can be made compact.

The cylindrical side wall 1*a* of the first vacuum container 1 is made of conductive material such as stainless steel. The first vacuum container 1 is composed of the side wall 1*a* and insulators 7, 8 each made of material such as ceramic and fixed to an end portion of the side wall 1*a*, and it contains therein a movable electrode 11, a part of a movable conductor 15, a fixed electrode 10 and a part of a fixed conductor 14. The movable conductor 15 and the fixed conductor 14 pass through the insulators 7 and 8, respectively. A small gap necessary for the movable conductor 15 to reciprocate is formed between the movable conductor 15 and the insulator 7, for example, the small gap is about 2 mm in difference between a hole of the insulator 7 and the diameter of the movable conductor 15. The first vacuum container 1 and the second vacuum container 2 are communicated with each other through the gap. Such a gap can be provided also between the fixed conductor 14 and the insulator 8 when required. The insulator 8 is fixed to and supported on the second vacuum container 2 by the conductive ring 9. Further, since the first vacuum chamber 1 is constructed by using the insulators 7 and 8, the first vacuum container 1 can be fixed to the second vacuum chamber 2 by fixing each of the insulators 7 and 8 to the second vacuum chamber 2, whereby the strength of support of the first vacuum chamber 1 is improved and the resistance to impact caused by operation of the movable electrode 11 is good. The insulator 8 has the conductor 14 passing through at a central portion thereof, and the conductor 14 has the fixed electrode 10 fixed to an end thereof. The movable electrode 11 is arranged to face the fixed electrode 10 thereby to form a circuit breaker 200. An end of the movable conductor 15 passing through the insulator 7 is connected to a movable rod 13 for operating the movable electrode 11 inside the first vacuum container 1, and the movable rod 13 is connected to an operation rod not shown through a link 21. The operation rod is connected to an operation box 102 containing therein the operation mechanism, and the movable electrode 11 and fixed electrode 10 are contacted or separated by operation of the operation mechanism.

Arc shields 16*a*, 16*b* are provided which are connected to the side wall 1*a* between the fixed electrode 10 and the insulator 8 and between the movable electrode 11 and the insulator 7 and on which an insulating material such as ceramic, for example, alumina ($Al_2O_3$), oxide zinc ($ZrO_2$) is coated by flame spray coating. An arc shield 16*c* is provided inside the insulator 8 and an arc shield 16*d* is provided inside the insulator 7. Outer peripheral portions of the arc shields 16*c*, 16*d* are positioned a little more outer than the inner peripheral portions of the arc shields 16*a*, 16*b* as if arc shields radially extended from inner peripheral portions of the arc shields 16*c*, 16*d* to the outer peripheral portions of the arc shields 16*a*, 16*b*. The inner surface of the side wall 1*a* is coated with an insulating material such as ceramic, for example, alumina ($Al_2O_3$), oxide zinc ($ZrO_2$) by flame spray coating, thereby to be protected from arcs leaked within the arc shields 16*a*, 16*b*. Therefore, the first vacuum container 1 can be used as an arc shield. Further, on the outer side of each of the insulators 7 and 8 forming a part of the first vacuum container 1, a shield 130, 131 for relaxing electric field is provided to relax the concentration of the electric field.

Since the first vacuum container 1 is contained in the second vacuum container 2 electrically insulated from the first vacuum container 1 and grounded in this manner, the first vacuum container 1 reaches to intermediate potential which is lower than the potential of the bus and higher than the earth potential, whereby it is possible to prevent dielectric breakdown from occurring between the first and second vacuum chambers 1, 2. Further, since the vacuum is kept by the first and second vacuum chambers, even if the vacuum of the first vacuum chamber 1 lowers, the insulation can be kept. Further, since the first vacuum chamber 1 and the second vacuum chamber 2 are communicated each other through the gap, it is possible to detect the vacuum of the first vacuum chamber 1 by measuring the vacuum of the second vacuum chamber 2.

In the above explanation, an example that the second vacuum chamber 2 is arranged outside the first vacuum chamber 1 is described, however, it is possible to provide a fourth vacuum chamber 140 or plural vacuum chambers outside the first vacuum chamber 1 and between the first vacuum chamber 1 and the second vacuum chamber 2, as shown in FIG. 3. In this example, the fourth vacuum chamber 140 is connected and fixed to the insulators 7 and 8. By constructing in this manner, the potential of each vacuum chamber becomes stepped potential at each wall of the first, fourth and second vacuum chambers, and it is possible to make it more uneasy to cause dielectric breakdown. As a result, even if the vacuum switchgear is made high in voltage, the outer diameter of the second vacuum container can be equal to or less than that of a vacuum chamber in the case where a single vacuum chamber is provided, whereby the switchgear can be made compact. Further, even if the degree of vacuum of the vacuum chamber decreases, the vacuum can be kept by a plurality of vacuum chambers, so that the insulation can be maintained.

In the present embodiment, the second vacuum chamber 2 containing therein the first vacuum container 1 is formed in a L-shape, that is, the second vacuum container 2 is composed of a part thereof in which the axis is in the same direction as the axis of the first vacuum container 1 and another part in which the axis is perpendicular to the axis of the first vacuum chamber 1. The side wall 2*a* of the second vacuum container 2 is made of conductive material such as stainless steel. On the side wall 2*a,* a cylindrical portion 18 is provided, and the cylindrical portion 18 and the movable rod 13 are connected by a bellows 17 to secure airtightness of the second vacuum container 2. An insulator 12 is provided between the movable conductor 15 passing through the insulator 7 and the movable rod 13, and a flexible conductor 60 is mounted on the insulator 12 on the side of the first vacuum container 1. In this manner, since the insulator 12 is provided in the second vacuum container 2, irrespective of the movable rod 13 being made of metal, it is possible to arrange the movable rod 13 at a position of a small distance from the side wall 2*a* or the bellows 17, whereby the vacuum switch can be made compact.

To the side wall 2*a,* an end of the flexible conductor 60 is fixed through an insulator 19. The insulator 19 is arranged on the reverse side to a third vacuum container 3 which will be described later, and in such arrangement, force in the reverse direction to the third vacuum 3 is applied on the conductor by electromagnetic force generated by current flowing in the conductor, however, the force can be supported in the compression direction of the insulator 19, whereby the durability is improved. The connecting conductor 62 also is mounted on a portion to which the flexible conductor 60 is fixed, and the connecting conductor 62 is connected to the fixed conductor 61. Both end portions of the flexible conductor 60 are provided with stoppers 132, 133, respectively, whereby the flexible conductor 60 is prevented from being bent excessively and the durability thereof is improved.

In the present embodiment, the fixed conductors 61 of the number corresponding to three phases are arranged at different positions in the direction of long axis of the second vacuum container 2 as shown by dotted line illustration, so that in the case where vacuum switches of the number corresponding to three phases are necessary to be arranged in row, each fixed conductor 61 can be wired with straight connecting conductor, and can be connected by simple wiring.

A bushing 63 is mounted on the side wall 2*a* at one end thereof to surround the outer periphery of the fixed conductor 61 and the fixed conductor 61 is connected to the other end of the bushing 63. The earth device 50 is mounted on one end of the flexible conductor 60. A fixed electrode 52 of the earth device 50 is mounted, on the side to opposite to the insulator 19, on the portion fixing the end of the flexible conductor 60. A movable electrode 51 is arranged to face the fixed electrode 52, and fixed to a movable rod 53. A bellows 54 is provided inside a cylindrical portion 55 of the side wall 2*a,* one end of the bellows 54 is connected to the cylindrical portion 55 and the other end is connected to the movable rod 53 through an insulator 59, whereby the airtightness of the second vacuum container 2 is kept. An earth conductor 58 is mounted on the movable rod 53, whereby the movable rod 53 is grounded. The movable rod 53 is connected to a link 56, and the link 56 is connected to an operation mechanism not shown. Operation rods are connected to the links 56 of the number corresponding to three phases, the three phase movable rods 53 are operated in a lump by an operation device not shown. In this manner, the movable rods 53 of the earth device 50 are constructed to reciprocate, so that it is possible to make contacts of the fixed and movable electrodes simple in construction.

To the both ends of the second vacuum container 2, end plates 20*a,* 20*b* each of which is convex inward are fixed by welding. By making the end plate convex, the end plate 20*a,* 20*b* can be made thin in thickness and light in weight. On any one of the end plates 20*a,* 20*b* grounded, a vacuum measurement apparatus 80 for measuring the degree of vacuum in the second vacuum container 2 is mounted. The vacuum measurement apparatus 80 employs a magnetron type measurement apparatus. As shown in FIG. 2, a magnetic member 81 extending near to coaxial electrodes 82*a* is fixed to the end plate 20*a,* and the vacuum measurement apparatus 80 is composed of the coaxial electrodes 82*a* and a coil or ring-shaped permanent magnet 82*b* arranged in a circumference of the coaxial electrodes for generating magnetic field. An inner electrode 82*c* of the coaxial electrodes 82*a* is connected to a power circuit 83, and a negative direct current is applied on the inner electrode 82*c* by the power circuit 83. By measuring ion current of anion ions generated by impact ionization with remaining gas by rotating movement of electrons e discharged from the inner electrode 82*c,* the degree of vacuum is measured.

Since the magnetic member 81 extending near to the coaxial electrodes 82*a* is provided as a member other than the end plate 20*a* in this manner, it is possible to prevent magnetic field of the permanent magnet 82*b* from permeating inside the end plate 20*a* and to improve the insulation between the conductor and the grounded container.

The third vacuum container 3 is mounted on the side of the fixed electrode 10 of the circuit breaker. By arranging it in this manner, the operation mechanism for operating the circuit breaker 200 and disconnecting switch 40 is easy to be installed, and the whole switchgear can be made compact. A cylindrical side wall 3*a* of the third vacuum container 3 is made of conductive material such as stainless steel, and the third vacuum container 3 is arranged in the direction that the axis of the third vacuum container 3 crosses the axis of the first vacuum container 1 at right angle and along the axis of the second vacuum container 2. A fixed electrode 41 of the disconnecting switch 40 is fixed to the conductor 14 on the opposite side to the fixed electrode 10. A movable electrode 42 is arranged so as to face the fixed electrode 41. To the movable electrode 42, a movable rod 44 is connected through a mounting portion of a flexible conductor 74 and an insulator 43. On the both end portions of the flexible conductor 74, stoppers 134, 135 are provided, respectively, whereby the flexible conductor 74 is prevented from being bent excessively and the durability thereof is improved. On the side wall 3*a,* a cylindrical portion 47 is provided, and a bellows 46 is provided inside the cylindrical portion 47. One end of the bellows 46 is connected to the cylindrical portion 47 and the other end is connected to the movable rod 44. Since the insulator 43 is provided inside the vacuum container in this manner, irrespective of the moving rod 44 being made of metal, it can be arranged at a small distance from the side wall 3*a* or the bellows 44 and it is possible to make t he size small.

Further, since e the fixed electrode 10 of the circuit breaker 200 and the fixed electrode 41 of the disconnecting switch 40 are provided on the both end portions of the conductor 14, respectively, by closing the circuit breaker after applying force on the electrode by slowly closing the disconnecting switch 40, it is possible to balance the force applied on the movable electrode 11 of the circuit breaker and the movable electrode 42 of the disconnecting switch 40. As a result, impact at time of closing the circuit breaker 200 can be received by the disconnecting switch side. Further, the insulator 8 can be made thin thereby an d the vacuum switch can be made small in size.

A conductor 70 is fixed to the side wall 3*a* through an insulator 75. The earth device 30 is provided on the conductor 70, wherein a fixed electrode 31 of the earth device 30 is fixed to the conductor 70 on a reverse side of the conductor 70 to the insulator 75. The earth device 30 can be omitted. The insulator 75 is provided at a position reverse to the second vacuum container 2. By arranging in this manner, force is applied on the conductor in a reverse direction to the second vacuum container 2 by electromagnetic force generated by current flowing in the conductor, however, the force can be supported in a compression direction of the insulator 75, whereby the durability is improved. A movable electrode 32 is arranged so as to face the fixed electrode 31. The movable electrode 32 is connected to a movable rod 33. A bellows 34 is provided inside a cylindrical portion 35 of the side wall 3*a*. An end of the bellows 34 is connected to the cylindrical portion 35 and the other end is connected to the moving rod 33 through an insulator 39, whereby airtightness of the third vacuum container 3 is kept. An earth conductor 36 is connected to the movable rod 33, and the movable rod 33 is grounded. The movable rod 33 is connected to a link 37, and the link 37 is connected to an operation mechanism not shown. The links 37 of the number corresponding to three phases are connected by a rod, and operated in a lump by the operation mechanism.

The conductor 70 and flexible conductor 74 are connected to each other at a connecting portion 76, and a switch 90 is provided between the connecting portion 76 and the earth device 30. The switch 90 has a fixed electrode 91 and a movable electrode 92 arranged so as to face the fixed electrode 91. The movable electrode 92 is connected to the movable rod 94 through an insulator 93. A bellows 96 is provided inside a cylindrical portion 97 of the side wall 3*a,* an end of the bellows 96 is connected to the cylindrical portion 97 and the other end is connected to the movable rod 94, whereby the airtightness of the third vacuum container 3 is kept. The movable rod 94 is connected to a link 101, and the link 101 is connected to an operation mechanism not shown. The links 101 of the number corresponding to three phases are connected by an operation rod and operated in a lump. An end of a flexible conductor 95 is connected to the movable electrode 92 and the other end to a fixed conductor 98. The fixed conductor 98 is connected to, for example, a potential transformer as a potential detector and an arrester. Since the conductor is connected to the potential transformer and arrester through the switch 90 in this manner, it is possible to measure potential in a proper time and improve the resistance to thunder by the arrester.

The conductor 70 is fixed and supported by a bushing 71 made of ceramic and fixed to the side wall 3*a*. The conductor 70 is connected to a cable 77 through the bushing 71 and a connection portion 72. A current transformer not shown is provided in an outer peripheral side of the cable 77. The end plate 20*b* of the second vacuum container 2 is arranged so as to have a gap between the cable 77 and the end plate 20*b,* and the cable 77 and the conductor 61 are led out in the same direction. The cable 77, however, can be led out in the reverse direction to the conductor 61, whereby freedom of wiring can be increased.

An end plate 78 which is convex toward the inside of the vacuum container is welded and fixed to an end of the third vacuum container 3 on the opposite side to the end portion at which the bushing 71 is provided. On the end plate 78 which is grounded, a vacuum measurement apparatus not shown for measuring the degree of vacuum of the third vacuum container 3 is mounted. The vacuum measurement apparatus, which is similar to the vacuum measurement apparatus 80, is composed of coaxial electrodes and a coil or ring-shaped permanent magnet arranged in its circumference for generating magnetic field. An inner electrode of the coaxial electrodes is connected to a power circuit. The power circuit applies negative direct current on the inner electrode. In the present embodiment, since the vacuum measurement apparatuses are provided for the second and third vacuum containers 2, 3, respectively, the degree of vacuum at time of power supply can be monitored. When the vacuum lowers less than $10^{-4}$ torr, the insulating ability lowers, so that a signal is sent to an alarm device or monitoring device. Here, that the vacuum lowers less than $10^{-4}$ torr means that it becomes $10^{-3}$ torr, for example.

Further, vacuum pump connecting portions can be provided for the second and third vacuum chambers 2, 3, whereby when the degree of vacuum lowers, the vacuum can be kept high by operating the vacuum pump or pumps.

An operation of the switchgear constructed in this manner will be described. When power is supplied, the earth devices 30, 50 are opened and the disconnecting switch 40, switch 90 and circuit breaker 200 are closed. The power to be supplied from t he b us is supplied to a load side through the bushing 63, fixed conductor 61, flexible conductor 60, movable conductor 15, movable electrode 11, fixed electrode 10, fixed conductor 14, flexible conductor 74, conductor 70 and bushing 71.

In the case where an accident occurs on the bus or load side, a sign al for opening the circuit breaker 200 puts out from a controller by a signal from a detector not shown, and a linear motion of the movable conductor 15 is effected by the operating mechanism. The linear motion of the movable conductor 15 shifts the movable electrode 11 from a closing state to an open state, thereby to break the circuit. At this time, arcs occur between the fixed electrode 10 and the movable electrode 11, however, most of the arcs are shielded by the arc shields 16*a* to 16*d* provided inside the first vacuum container 1, and the side wall 1*a* is protected from arcs. The side wall portion subjected to arcs leaked inside the arc shields 16*a,* 16*b* of a linearly moving portion of the movable electrode 15 is protected from the arcs by the coating of insulating material formed by flame spray coating. when the circuit breaker 200 is opened, the movable rod 44 of the disconnecting switch 40 is shifted by the operation mechanism according to a control signal from the controller so that the movable electrode 42 is separated from the fixed electrode 41 and the disconnecting switch 40 becomes a disconnected state. Then, the movable rod 33 of the earth device 30 is shifted so that the movable electrode 32 contacts with the fixed electrode 31, whereby the conductor is grounded. Further, the movable rod 53 of the earth device 50 is shifted so that the movable electrode 51 is contacted with the fixed electrode 52 to effect grounding.

Since the vacuum switch is constructed in a laterally-laid-U shape by the L-shaped second vacuum container and the third vacuum container, a bus side unit and a transformer side unit can be made common. Further, the vacuum switches can be arranged parallel, whereby a compact switchgear can be provided.

Since the movable rod 13 for the circuit breaker 200 is constructed of a driving system reciprocating the movable rod 13 and the fixed electrode 10 of the circuit breaker and the fixed electrode 41 of the disconnecting switch are arranged at both ends of the fixed conductor 14, the force applied on the movable electrode 11 of the circuit breaker and the force applied on the movable electrode 42 of the disconnecting switch can be balanced, so that the thickness of the insulator 8 can be formed thin and made small in size. Further, the first vacuum container 1 containing therein the circuit breaker 200 and the third vacuum container 3 containing therein the disconnecting switch 40 and earth device 30 are constructed so that they are connected each other, the insulation reliability is improved. Further, the disconnecting switch and the earth device can be assembled individually from the circuit breaker, so that the freedom of constructing the switchgear increases.

The space in the vacuum measurement apparatus communicates with the vacuum container and the vacuum of the vacuum container is measured or always monitored by the vacuum measurement apparatus, whereby the safety and reliability of the vacuum switch can be improved.

Since the first vacuum container 1 containing the circuit breaker 200 and the second vacuum container 2 are communicated with each other and the second vacuum container 2 and the third vacuum container 3 are interrupted in vacuum, in the case where any disadvantage occurs in the first and second vacuum containers the circuit breaker can be opened, and in the case where any disadvantage occurs in the third vacuum container the circuit breaker can be opened, so that the safety is improved.

Figure 4:
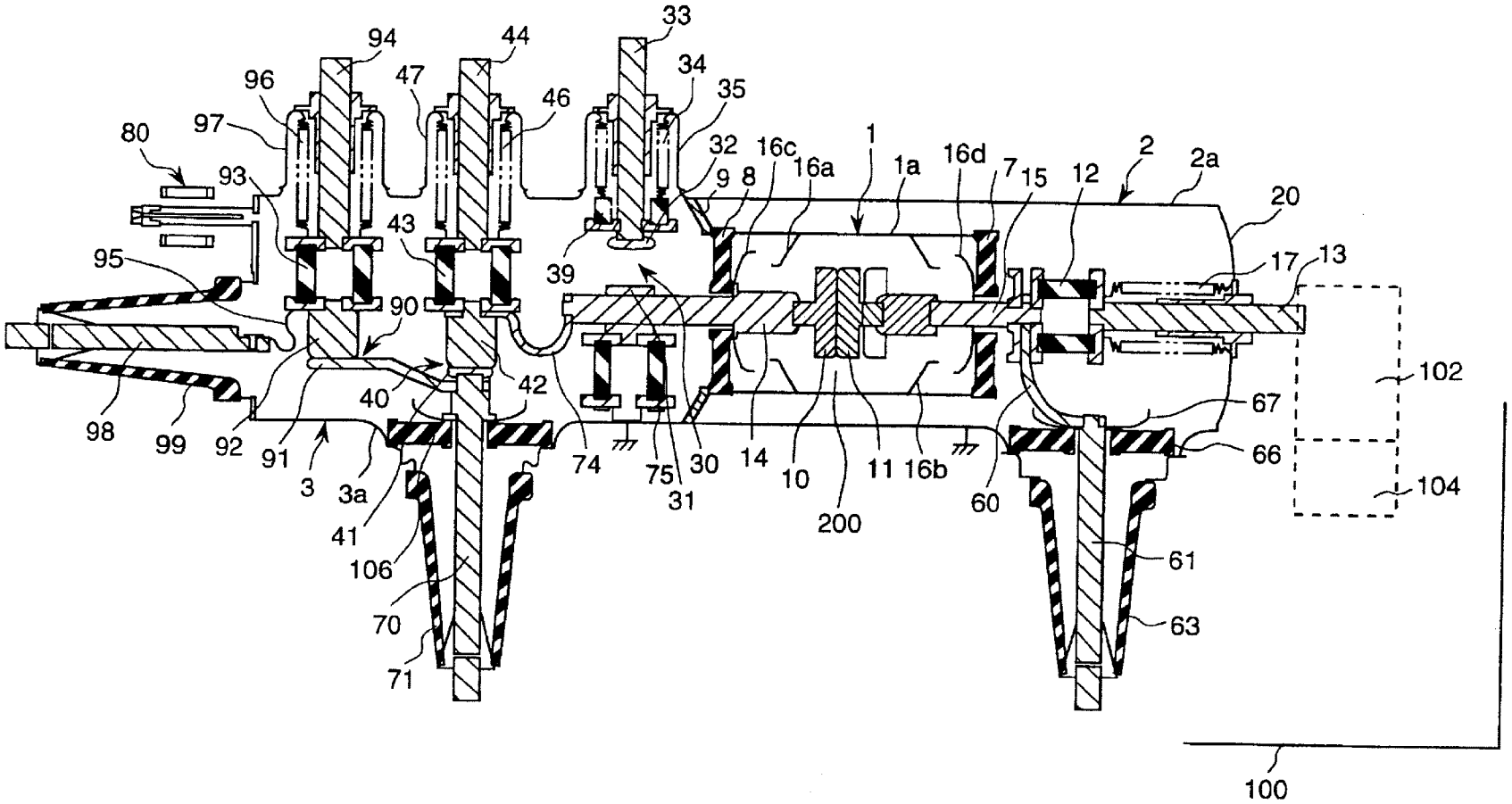
FIG. 4 is a sectional side view of a vacuum switchgear of a second embodiment of the present invention.

A second embodiment of the present invention will be described hereunder, referring to FIG. 4. FIG. 4 is a sectional side view of a vacuum switch of the second embodiment.

The vacuum switch of the present embodiment is constructed as follows. Here, parts or components having a function the same as or similar to those of the first embodiment are given the same reference numbers.

A first vacuum container 1 comprises a cylindrical side wall 1*a* and insulators 7, 8 fixed to end portions of the cylindrical side wall 1*a* which is made of conductive material such as stainless steel or the like. The insulators 7, 8 each are made of, for example, ceramic. The insulator 8 is fixed and supported to a second vacuum container 2 through a conductive or insulating ring 9, whereby the first vacuum container 1 is supported by the second vacuum container 2. The first vacuum container 1 also can be fixed to the second vacuum container 2 by both the insulators 7 and 8 as described in the first embodiment. A fixed conductor 14 is provided at a central portion of the insulator 8, and a fixed electrode 10 is fixed to an end of the conductor 14 inside the first vacuum container 1. A movable electrode 11 is provided so as to face the fixed electrode 10 to construct a circuit breaker 200. A movable conductor 15 has the movable electrode 11 fixed thereto at one end and operates the movable electrode 11 of the circuit breaker in the first vacuum container 1. The movable conductor 15 passes through the insulator 7 and is connected to a flexible conductor 60 and to a movable rod 13 through an insulator 12. The movable rod 13 is connected to an operation box 102 containing therein an operation mechanism and causes the movable conductor 15 to reciprocate by an operation of the operation mechanism. Reciprocation of the movable conductor 15 causes the movable electrode 11 to contact with or separate from the fixed electrode 10.

Arc shields 16*a,* 16*b* each coated with ceramic by flame spray coating are provided between the fixed electrode 10 and the insulator 8 and between the movable electrode 11 and the insulator 7. An arc shield 16*c* is provided inside the first container 1 on the inner side of the insulator 8, and an arc shield 16*d* also is provided inside the first vacuum container 1 on the inner side of the insulator 7. Outer peripheral portions of the arc shields 16*c,* 16*d* are positioned radially at positions a little more outer than the inner peripheral portions of the arc shields 16*a,* 16*b* as if arc shield extended from the electrodes to the side wall 1*a*. An inner surface of the side wall 1*a* is coated with ceramic by flame spray coating and protected from arcs leaking inside the arc shields 16*a,* 16*b*.

The second vacuum container 2 containing the first vacuum container 1 is arranged so that the axis of the second vacuum container 2 is in the same direction as the axis of the first vacuum container 1. When the first vacuum container 1 communicates with the second vacuum container 2 and the second vacuum container 2 and a third vacuum container 3 are isolated from each other with respect to vacuum, it is possible to contain the first vacuum container 1 inside the third vacuum container 3 or to contain a part of the first vacuum container 1 in one of the second and third vacuum containers 1, 2 and the other part in the other of the vacuum containers 1, 2. The second vacuum container 2 is arranged so as to surround the outer periphery of the first vacuum container 1 at the distance set so that the side wall 1*a* of the first vacuum container 1 becomes intermediate potential. An end plate 20 which is convex toward the outside of the vacuum container is welded and fixed to one end of the second vacuum container 2. A vacuum measurement apparatus not shown for measuring the degree of vacuum of the second vacuum container 2 is mounted on the end plate 20. The vacuum measurement apparatus is constructed as shown in FIG. 2. The insulator 12 is provided between the movable conductor 15 passing through the insulator 7 and a bellows 17, and a flexible conductor 60 is provided on the insulator 12 on the side of the first vacuum container 1. Further, the insulator 12 is connected to an end of a movable rod 13 the other end of which passes through the end plate 20 to be out of the vacuum container. The end plate 20 and an end of the insulator 12 are connected by the bellows 17 surrounding the movable rod 13 to maintain the airtightness of the second vacuum container 2. Since the insulator 12 is provided inside the vacuum container in this manner, the movable rod 13 can be arranged at a small distance from the side wall 2*a* or the bellows 17 irrespective of the movable rod 13 being made of metal, whereby the size can be made small. An insulator 66 is provided on the side wall 2*a,* and an end of the flexible conductor 60 is fixed to a conductor 61 passing through the insulator 66 and fixed thereto. A shield 67 for relaxing electric field is provided on the insulator 66 on the side of the first vacuum container 1 to relax the concentration of electric field. A bushing 63 is provided on th e side wall 2*a* in the circumference of the conductor 61 and the conductor 61 is connected to a conductor on the side of a bus.

Since the first vacuum container 1 is contained in the second vacuum container 2 which is electrically insulated from the first vacuum container 1 and grounded in this manner, the first vacuum container 1 is intermediate potential lower than the potential of the bus and higher than the earth potential, whereby it is possible to prevent dielectric breakdown from occurring between the first and second vacuum containers 1 and 2. Further, since the vacuum is maintained by the first and second vacuum containers 1 and 2, the insulation can be maintained even if the degree of vacuum of the first vacuum container 1 decreases.

In the above explanation, an example that the second vacuum container 2 is provided outside the first vacuum container 1 is described, however, as shown in FIG. 3, a fourth vacuum container 140 or containers can be provided outside the first vacuum container 1 and between the first and second vacuum containers 1 and 2.

The third vacuum container 3 is mounted on the circuit breaker on the side of the fixed electrode 10. The cylindrical side wall 3*a* of the third grounded vacuum container 3 is made of conductive material such as stainless steel, and the third vacuum container 3 is arranged so that the axis of the third vacuum container 3 is in the same direction as the axis of the second vacuum container 2. The conductor 14 passed through the insulator 8 is connected to the side wall 3*a* through an insulator 75, and a fixed electrode 31 of an earth device 30 is provided on the opposite side to the insulator 75. A movable electrode 32 is provided so as to face the fixed electrode 31. The movable electrode 32 is connected to an movable rod 33. A bellows 34 is provided inside a cylindrical portion 35 of the side wall 3*a,* an end of the bellows 34 is connected to the cylindrical portion 35 and the other end to the movable rod 33 through an insulator 39, whereby the airtightness of the third vacuum container 3 is kept. An earth conductor not shown is mounted on the movable rod 33, whereby the movable rod 33 is grounded. The movable rod 33 is connected to a link not shown, the link is connected to an operation mechanism contained in an operation box 102. The arrangement can be reverse. Since the insulator 39 is provided within the vacuum container, it is possible to arrange the movable rod 33 at a small distance from the side wall 3*a* or bellows 34 irrespective of the movable rod 33 made of metal and the size can be made small.

A flexible conductor 74 is connected to the conductor 14, and a disconnecting switch 40 is provided on an end of the flexible conductor 74. The flexible conductor 74 is connected to the movable electrode 42 and the movable electrode 42 is connected to a movable rod 44 through an insulator 43. The side wall 3*a* is provided with a cylindrical portion 47, and a bellows 46 is connected to the cylindrical portion 47 and an end of the insulator 43 to maintain the airtightness of the third vacuum container 3. The movable rod 44 is connected to an operation mechanism not shown through a link not shown. Since the insulator 43 is provided inside the vacuum container in this manner, it is possible to arrange the movable rod 44 at a small distance from the side wall 2*a* or bellows 46 irrespective of the movable rod 44 made of metal, and the size cam be made small. The fixed electrode 41 is arranged so as to face the movable electrode 42. A conductor 70 connected to the fixed electrode 41 is provided passing through an insulator 106 fixed to the side wall 3*a,* and fixed and supported by the insulator 106. A bushing 71 is provided in the outer periphery side of the conductor 70. The bushing 71 is arranged in the same direction as a bushing 63 and the conductor is connected to the negative side.

Since the insulators 66, 106 are provided in this manner, although such force as to expand between the conductor 70 and conductor 61 is applied on the conductors 70 and 61 by electromagnetic force generated by current flowing the conductors, the insulators 66 and 106 can receive the force.

A fixed electrode 91 of a switch 90 is connected to the fixed electrode 41 of the disconnecting switch 40, and a movable electrode 92 is provided so as to face the fixed electrode 91. A movable rod 94 is connected to the movable electrode 92 through a mounting portion of a flexible conductor 95 and an insulator 93. The side wall 3*a* is provided with a cylindrical portion 97, and a bellows 96 is provided inside the cylindrical portion 97. An end of the bellows 96 is connected to the cylindrical portion 97 and the other end to the movable rod 94 to maintain the airtightness of the third vacuum container 3. Since the insulator 93 is provided inside the vacuum container in this manner, the movable rod 94 can be arranged in a small distance from the side wall 3*a* or bellows 96 irrespective of the movable rod 94 made of metal, and the size can be made small.

A conductor 98 connected to the flexible conductor 95 is fixed and supported by a bushing 99 made of ceramic and fixed to the side wall 3*a.* A connection portion not shown is provided outside the bushing 99, the conductor is connected to a potential transformer and an arrester by the connection portion.

A vacuum measurement apparatus 80 for measuring the degree of vacuum of the third vacuum container 3 is mounted on a lateral side of the side wall 3*a* that the bushing 99 of the third vacuum container 3 is provided. The vacuum measurement apparatus 80 is composed of coaxial electrodes and a coil or ring-shaped permanent magnet arranged in the peripheral portion for generating magnetic field, as shown in FIG. 2. An inner electrode of the coaxial electrodes is connected to a power circuit and applied with negative current voltage by the power circuit. Further, it is possible to provide a connection portion or portions of a vacuum pump or pumps on the second and third vacuum containers 2, 3, whereby when the vacuum decreases, the vacuum can be kept high by operation of the vacuum pumps.

Since the second vacuum container 2 and the third vacuum container 3 are linearly arranged to construct vacuum switch in this manner, a switchgear the depth (the size in a direction perpendicular to a long axis of the vacuum switch) of which is small can be provided. Further, since the second and third containers 2, 3 are grounded and the side walls 2*a,* 3*a* become earth potential, it is possible to arrange the switches of three phases at a contacting or adjacent relation to each other, whereby a compact switchgear can be provided. Further, by arranging the operation mechanism for operating the switches of three phases in a lump within the width of the vacuum switches of the number corresponding to three phases, arranged in an adjacent relation with each other, it is possible to arrange plural sets of the vacuum switches of three phases thereby to arrange switches of the number corresponding to 6 phases or more.

Further, the first vacuum container containing therein the circuit breaker and the third vacuum container containing therein the disconnecting switch and earth device are constructed so that they are connected to each other, the insulation reliability is improved. Further, the circuit breaker, the disconnecting switch and the earth device can be assembled individually, so that the freedom of constructing the switchgear increases.

The space in the vacuum measurement apparatus communicates with the vacuum container and the vacuum of the vacuum container is measured or always monitored by the vacuum measurement apparatus, whereby the safety and reliability of the vacuum switch can be improved.

The above-mentioned vacuum switches of the number corresponding to three phases or more and the operation box 102, a protective relay box, etc. are contained in a metal box 100, thereby to from a switchgear.

Figure 5:
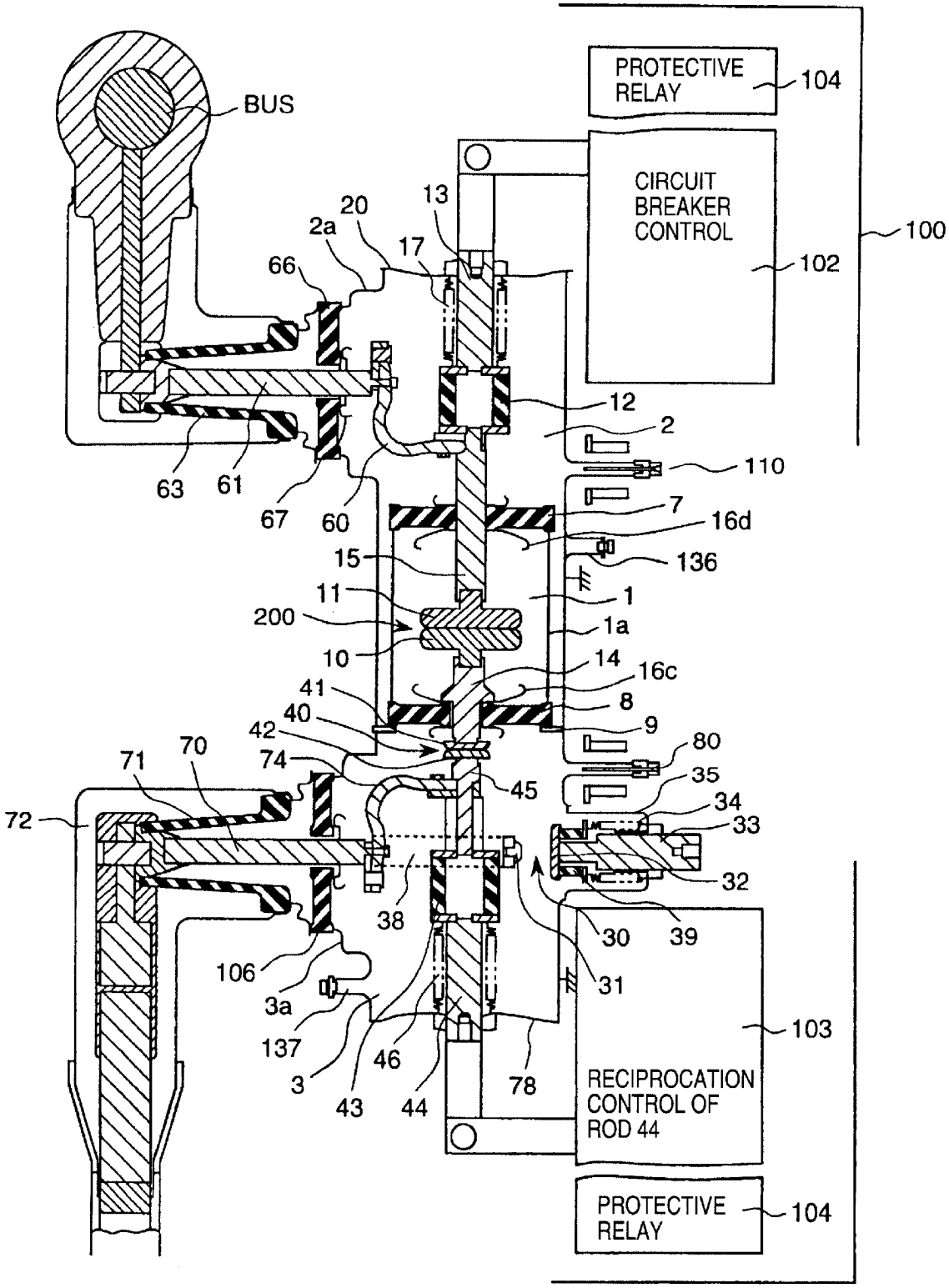
FIG. 5 is a sectional side view of a vacuum switchgear of a third embodiment of the present invention.
Figure 6:
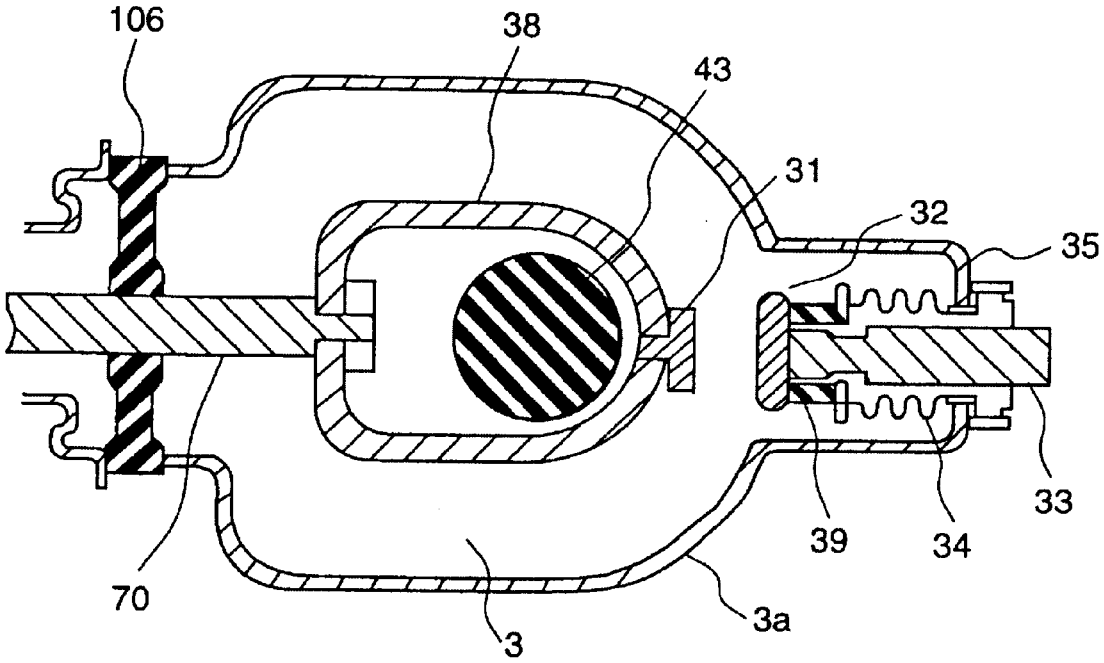
FIG. 6 is a lateral sectional view of a construction of an earth device in the third embodiment of the present invention.

A third embodiment of the present invention will be described hereunder, referring to FIGS. 5 and 6. FIG. 5 is a side-sectional view of a vacuum switch of the third embodiment and FIG. 6 is a lateral sectional view of an earth device.

The vacuum switch of the present embodiment is constructed as follows. Here, parts or components having a function the same as or similar to those of the first embodiment are given the same reference numbers.

A cylindrical side wall 1*a* of a first vacuum container 1 is formed of conductive material such as stainless steel or the like, the side wall 1*a* is fixed and supported by a portion of an insulator 8 made of, for example, ceramic and supported by a portion of an insulator 7. The insulator 8 is fixed and supported to a second vacuum container 2. The first vacuum container 1 can be fixed to the second vacuum container 2 by both the insulator 7 and the insulator 8 as described in the first embodiment. A conductor 14 is provided at a central portion of the insulator 8, and a fixed electrode 10 is provided on the conductor 14 inside the first vacuum container 1. A movable electrode 11 is provided so as to face the fixed electrode 10 to construct a circuit breaker 200. A movable conductor 15 operating the movable electrode 11 of the circuit breaker 200 in the first vacuum container 1 passes through the insulator 7 and is connected to a flexible rod 13 through an insulator 12. The movable rod 13 is connected to an operation box 102 containing therein an operation mechanism and causes the movable conductor 15 to reciprocate by an operation of the operation mechanism. Reciprocation of the movable conductor 15 causes the movable electrode 11 to contact with or separate from the fixed electrode 10.

An arc shield 16*c* coated with ceramic by flame spray coating is provided inside the first container 1 on the inner side of the insulator 8, and an arc shield 16*d* also is provided inside the first vacuum container 1 on the inner side of the insulator 7. An inner surface of the side wall 1*a* is coated with ceramic by flame spray coating and protected from arcs.

In the present embodiment, arc shields 16*a,* 16*b* are omitted by making the diameter of the electrodes large thereby to make the arc sufficiently stable. Since the arc shields 16*a,* 16*b* are not provided in this manner, the axial length of the first vacuum container 1 can be made short. As a result, the volume of the first vacuum container 1 can be made small, so that it is easy to maintain the vacuum.

The second vacuum container 2 containing the first vacuum container 1 is arranged so that the axis of the second vacuum container 2 is in the same direction as the axis of the first vacuum container 1. The first vacuum container 1 is contained in a third vacuum container 3 as in the second embodiment, or it is possible to contain the first vacuum container 1 in both the second and third vacuum containers so that a part of the first vacuum container is in the second vacuum container and the other part in the third vacuum container. The second vacuum container 2 is arranged so as to surround the outer periphery of the first vacuum container 1 at the distance set so that the side wall 1*a* of the first vacuum container 1 reaches to intermediate potential. An end plate 20 which is convex toward the inside of the vacuum container is welded and fixed to one end of the second vacuum container 2. A vacuum measurement apparatus 80 for measuring the degree of vacuum of the second vacuum container 2 is mounted on the second vacuum container 2. The vacuum measurement apparatus is constructed as shown in FIG. 2. Further, a connection portion 136 to a vacuum pump not shown is provided. An insulator 12 is provided between a movable conductor 15 passing through the insulator 7 and a bellows 17, and a flexible conductor 60 is provided on an insulator 12 on the side of the first vacuum container 1. The end plate 20 and an end of the insulator 12 are connected by the bellows 17 to maintain the airtightness of the second vacuum container 2. Since the insulator 12 is provided inside the vacuum container in this manner, a movable conductor 15 can be arranged at a small distance from the side wall 2*a* or the bellows 17 irrespective of the movable rod 13 made of metal, whereby the size can be made small. An insulator 66 is provided on the side wall 2*a,* and an end of the flexible conductor 60 is fixed to a conductor 61 passing through the insulator 66 and fixed thereto. The flexible conductor 60 is bent at right angle and an axial direction of the conductor 61 is arranged in a direction perpendicular to the axial direction of the first vacuum container 1. Therefore, the depth of the container can be made small. A shield 67 for relaxing the electric field is provided on the insulator 66 on the side of the first vacuum container 1. A bushing 63 is provided on the side wall 2*a* in an outer peripheral side of the conductor 61 and the conductor 61 is connected to a bus arranged on the upper side.

Since the first vacuum container 1 is contained in the vacuum container 2 which is electrically separated from the first vacuum container 1 and grounded in this manner, the first vacuum container 1 becomes intermediate potential which is lower than the potential of the bus and higher than the earth potential, whereby it is possible to prevent dielectric breakdown from occurring between the first and second vacuum containers 1 and 2. Further, since the vacuum is maintained by the first and second vacuum containers 1 and 2, the insulation can be maintained even if the degree of vacuum of the first vacuum container 1 decreases. In the above explanation, the example that the second vacuum container 2 is provided outside the first vacuum container 1 is described, however, as shown in FIG. 3, a fourth vacuum container 140 or containers can be provided outside the first vacuum container 1 and between the first and second vacuum containers 1 and 2.

The third vacuum container 3 is mounted on the circuit breaker on the side of the fixed electrode 10. The cylindrical side wall 3*a* of the third grounded vacuum container 3 is made of conductive material such as stainless steel, and the third vacuum container 3 is arranged so that the axis of the third vacuum container 3 is in the same direction as the axis of the second vacuum container 2. A conductor 14 passed through the insulator 8 is connected to the side wall 3*a,* and a fixed electrode 41 of a disconnecting switch 40 is provided on the conductor 14 on the side of the third vacuum container 3. A movable electrode 42 is arranged to face the fixed electrode 41. A movable rod 44 is connected to the movable electrode 42 through a movable conductor 45, a connection portion of a flexible conductor 74 and an insulator 43. An end plate 78 and an end of the insulator 43 are connected by a bellows 46 to maintain the air tightness of the third vacuum container 3. The movable rod 44 is connected to an operation box 103 containing an operation mechanism, the rod 44 is driven to reciprocate by an operation of the operation mechanism. Reciprocation of the movable rod 44 causes the movable electrode 42 and the fixed electrode 41 to contact with and separate from each other. Since the fixed electrode 10 of the circuit breaker and the fixed electrode 41 of the disconnecting switch 40 are provided on the both ends of the conductor 14 in this manner, after the disconnecting switch 40 is slowly closed and force is applied, the circuit breaker is closed, whereby the force applied on the movable electrode 11 of the circuit breaker can be balanced with the movable electrode 42 of the disconnecting switch 40, the insulator 8 can be made thin and the size can be made small.

An earth device 30 provided at the position of an connection portion of the insulator 43 and the movable conductor 45 is constructed as shown in FIG. 6. A fixed electrode 31 is provided on a conductor 38 arranged so as to surround the insulator 43 and connected to a conductor 70 described later at a position reverse to the conductor 70. A movable electrode 32 is arranged so as to face the fixed electrode 31. The movable electrode 32 is connected to a movable rod 33 through an insulator 39. A bellows 34 is provided inside a cylindrical portion 35 of the side wall 3*a,* an end of the bellows 34 is connected to the cylindrical portion 35 and the other end to the movable rod 33 through an insulator 39, whereby the airtightness of the third vacuum container 3 is kept. Since the insulator 39 is provided inside the vacuum container, it is possible to arrange it at a small distance from the side wall 3*a* or the bellows 34 irrespective of the movable rod being made of metal. An earth conductor not shown is mounted on the movable rod 33, whereby the movable rod 33 is grounded. The movable rod 33 is connected to a link not shown, and the link is connected to an operation mechanism not shown. the insulator 43 and the movable conductor 45 are arranged so as to pass through the conductor 38. An end of a flexible conductor 74 is connected to the movable conductor 45 and the other end to the conductor 70. The flexible conductor 74 is formed bent at right angle, and the conductor 70 is arranged in the direction that the axial direction thereof crosses the axial direction of the first vacuum conductor 1 at right angle. Therefore, the depth size can be made small. The conductor 70 is provided passing through an insulator 106 fixed to the side wall 3*a,* and fixed and supported by the insulator 106. A bushing 71 is provided in the outer periphery side of the conductor 70. The bushing 71 is connected to a cable 77 through a connection portion 72. Since the insulators 66, 106 are provided in this manner, although force so as to expand between the conductor 70 and conductor 61 is applied on the conductors 70 and 61 by electromagnetic force generated by current flowing in the conductors, the insulators 66 and 106 can receive the force.

A vacuum measurement apparatus 80 for measuring the degree of vacuum of the third vacuum container 3 is mounted on a lateral side of the side wall 3*a*. The vacuum measurement apparatus 80 is composed of coaxial electrodes and a coil or a ring-shaped permanent magnet arranged in the peripheral portion for generating the magnetic field, like the vacuum measurement apparatus 80 shown in FIG. 2. An inner electrode of the coaxial electrodes is connected to a power circuit and applied with negative current voltage by the power circuit. Further, a connection portion 137 to a vacuum pump is provided.

In this example, the example that the operation boxes 102, 103 are arranged sidewards of the second and third vacuum containers 2, 3, respectively, however, the operation boxes 102, 103 can be arranged under the second vacuum container 2 and over the third vacuum container 3, and by such an arrangement, the vacuum measurement apparatus and the operation mechanism of the earth device 30 can be arranged sidewards of the second and third vacuum containers and the whole apparatus can be made compact. Further, the operation mechanism can be arranged within the width the vacuum switches of the number corresponding to three phases, whereby it is possible to arrange plural sets of the vacuum switches of six phases or more. Further, although not shown, a potential transformer, a conductor connected with an arrester, and an switch can be provided in the second vacuum container 2.

The switchgear comprises the vacuum switches, the operation boxes 102, 103 and protective relay box 104, each contained in a metal box 100.

Since the second and third vacuum containers are linearly arranged to construct the vacuum switchgear in this manner, the switchgear the depth of which is small can be provided. Further, the second and third vacuum containers 2, 3 are grounded and the side wall is earth potential, so that switches of the number corresponding to three phases can be arranged closely to each other and a compact switchgear can be provided.

Further, since the fixed electrode of the circuit breaker and the fixed electrode of the disconnecting switch are arranged at the both ends of the fixed conductor in a driving system reciprocating the movable rod of the circuit breaker, the force applied on the movable electrode of the circuit breaker and the force applied on the movable electrode of the disconnecting switch can be balanced, so that the insulator 8 can be formed thin and the switchgear can be made small in size. Further, the first vacuum container containing therein the circuit breaker and the third vacuum container containing therein the disconnecting switch and earth device are constructed so that they are connected to each other, the insulation reliability is improved. Further, the circuit breaker, the disconnecting switch and the earth device can be assembled individually, so that the freedom of constructing the switchgear increases.

The space of the vacuum measurement apparatus communicates with the vacuum container and the vacuum of the vacuum container is measured or always monitored by the vacuum measurement apparatus, whereby the safety and reliability of the vacuum switch can be improved.

As mentioned above, the vacuum switches of each embodiment and the switchgear using the switches have the following effects.

Since the first vacuum container 1 is contained in the second vacuum container 2 which is electrically separated from the first vacuum container 1 and grounded, the first vacuum container 1 becomes intermediate potential between potential of the bus and the earth potential, whereby it is possible to prevent dielectric breakdown from occurring between the first and second vacuum containers. Further, the vacuum is maintained by the first and second vacuum containers, so that the insulation can be maintained even if the vacuum of the first vacuum container lowers.

The vacuum switches can be arranged in parallel, so that a compact switchgear can be provided. Further, since the fixed electrode of the circuit breaker and the fixed electrode of the disconnecting switch are arranged at the both ends of the fixed conductor in a driving system reciprocating the movable rod of the circuit breaker, the force applied on the movable electrode of the circuit breaker and the force applied on the movable electrode of the disconnecting switch can be balanced, so that the insulator 8 can be formed thin and the switchgear can be made small in size.

Further, the first vacuum container containing therein the circuit breaker and the third vacuum container containing therein the disconnecting switch and earth device are constructed so that they are connected each other, the insulation reliability is improved. Further, the circuit breaker, the disconnecting switch and the earth device can be assembled individually, so that the freedom of constructing the switchgear increases.

The space of the vacuum measurement apparatus communicates with the vacuum container and the vacuum of the vacuum container is measured or always monitored by the vacuum measurement apparatus, at the same time, the vacuum is maintained by the vacuum pump, so that the safety and reliability of the vacuum switch can be improved.

What is claimed is:

1. A vacuum switch comprising:

a first vacuum container containing therein a fixed electrode and a movable electrode of a circuit breaker;

a second vacuum container electrically insulated from said first vacuum container and grounded, and containing therein said first vacuum container; and wherein said circuit breaker is electrically connected to a bus, and said second vacuum container is arranged at such a distance from said first vacuum container that the potential of said first vacuum container is intermediate potential lower than the said bus and higher than earth potential.

2. A vacuum switch comprising:

a first vacuum container containing therein a fixed electrode and a movable electrode of a circuit breaker;

a second vacuum container electrically insulated from said first vacuum container and grounded, and containing therein said first vacuum container; and wherein a least one vacuum chamber is provided between said first and second vacuum containers so as to contain said first vacuum container.

3. A vacuum switch comprising:

a first vacuum container containing therein a fixed electrode and a movable electrode of a circuit breaker;

a second vacuum container electrically insulated from said first vacuum container and grounded, and containing therein said first vacuum container; and an insulator disposed in said second vacuum chamber and fixed both to a movable conductor connected to said movable electrode of said circuit breaker inside said first vacuum container and to a movable rod for operating said movable conductor, said movable rod being driven by an operation mechanism disposed out of said first and second vacuum containers.

4. A vacuum switch according to claim 3, wherein said first vacuum container is formed by a cylindrical side wall and insulators fixed to ends of said cylindrical side wall, one of said insulators having a hole through which said movable conductor passes, said second vacuum container having a side wall portion surrounding said cylindrical side wall of said first vacuum container with a relatively small space therebetween, and said first vacuum container communicates with said second vacuum container through a gap formed between said movable conductor and said hole formed in said insulator.

5. A vacuum switch according to claim 3, wherein said second vacuum container contains therein an earth device electrically connected to said circuit breaker through a conductor to ground said conductor when said circuit breaker is opened.

6. A vacuum switch comprising:

a first vacuum container containing therein a circuit breaker;

a second vacuum container electrically insulated from said first vacuum container, containing therein said first vacuum container and grounded; and a third vacuum container connected to said second vacuum container, containing therein a disconnecting switch and grounded.

7. A vacuum switch according to claim 6, wherein said first vacuum container communicates in vacuum with said second vacuum container through a gap.

8. A vacuum switch according to claim 6, wherein said first vacuum container communicates in vacuum with said second vacuum container through a gap, and the vacuum of the third vacuum container is isolated from the vacuum of said first and second vacuum containers.

9. A vacuum switch according to claim 6, wherein at least one of an earth device and a switch for connecting an arrester and/or a potential transformer is arranged in said third vacuum container.

10. A vacuum switch according to claim 6, wherein a least one vacuum chamber is provided between said first and second vacuum containers so as to contain said first vacuum container.

11. A vacuum switch comprising:

a first vacuum container containing therein a circuit breaker;

a second vacuum container electrically insulated from said first vacuum container and containing therein said first vacuum container and grounded;

an insulator disposed in said second vacuum chamber and fixed both to a movable conductor connected to said movable electrode of said circuit breaker inside said first vacuum container and to a movable rod for operating said movable conductor, said movable rod being driven by an operation mechanism disposed out of said fist and second vacuum containers; and a third vacuum container connected to said second vacuum container, containing a disconnecting switch and grounded.

12. A vacuum switch according to claim 11, wherein said fixed and movable electrodes of said circuit breaker, said insulator disposed in said second vacuum container and fixed to said movable conductor and said movable rod, and said disconnecting switch in said third vacuum container are arranged on a substantially straight line, said insulator and said disconnecting switch are arranged so that said circuit breaker is disposed therebetween.

13. A vacuum switch according to claim 11, wherein said fixed electrode of said circuit breaker and said fixed electrode of said disconnecting switch are arranged on opposite ends of a straight conductor, respectively.

14. A vacuum switch according to claim 11, wherein at least one of an earth device and a connecting switch for an arrester and/or a potential transformer is arranged in said third vacuum container.

15. A vacuum switch according to claim 11, wherein at least one vacuum chamber is provided between said first and second vacuum containers so as to contain said first vacuum container.

16. A vacuum switch according to claim 11, wherein said third vacuum container is connected to said first vacuum container on the side of said fixed electrode of said circuit breaker of said first vacuum container.

17. A vacuum switch comprising:

a first vacuum container containing therein a circuit breaker;

a second vacuum container electrically insulated from said first vacuum container and containing therein said first vacuum container and grounded; and a third vacuum container connected to said second vacuum container, containing a disconnecting switch and grounded, wherein long-directional axes of said second and third vacuum containers each are a different direction from a long-directional axis of said first vacuum container.

18. A vacuum switch according to claim 17, wherein said second and third vacuum containers are arranged so as to extend from long-directional end portions of said first vacuum containers in the same direction, thereby to form a laterally-laid-U shape.

19. A vacuum switch according to claim 17, wherein a bus connection portion provided in said second vacuum container and a load side connection portion provided in said third vacuum container are provided on the same side to said first vacuum container.

20. A vacuum switchgear comprising vacuum switches of the number corresponding to three phases or more, each vacuum switch being as defined in claim 1, a protective relay device and an operation box containing therein an operation mechanism for operating said circuit breaker, each being arranged in a metal box.

* * * * *